US007817951B2

(12) United States Patent
Takiguchi et al.

(10) Patent No.: US 7,817,951 B2
(45) Date of Patent: Oct. 19, 2010

(54) CLEANING MEMBER AND IMAGE FORMING APPARATUS USING THE SAME

(75) Inventors: Toshiki Takiguchi, Yamatokoriyama (JP); Kan Mukai, Yamatokoriyama (JP); Takashi Yamanaka, Yamatokoriyama (JP); Tatsuya Inoue, Nara (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 1029 days.

(21) Appl. No.: 11/484,638

(22) Filed: Jul. 12, 2006

(65) Prior Publication Data

US 2007/0048040 A1 Mar. 1, 2007

(30) Foreign Application Priority Data

Aug. 31, 2005 (JP) ..... 2005-251250
Dec. 12, 2005 (JP) ..... 2005-357263

(51) Int. Cl.
*G03G 15/20* (2006.01)

(52) U.S. Cl. ..... 399/327; 101/425

(58) Field of Classification Search ..... 399/327, 399/99; 101/425

See application file for complete search history.

(56) References Cited

U.S. PATENT DOCUMENTS 4,324,482 A * 4/1982 Szlucha ..... 399/327
4,407,219 A * 10/1983 Dellevoet ..... 118/60
4,686,132 A * 8/1987 Sumii et al. ..... 428/171
5,478,423 A * 12/1995 Sassa et al. ..... 156/187
5,563,697 A * 10/1996 Saito ..... 399/358
5,784,674 A * 7/1998 Iseki et al. ..... 399/297
5,800,908 A * 9/1998 Hobson et al. ..... 428/198
6,041,211 A * 3/2000 Hobson et al. ..... 399/352
6,117,528 A * 9/2000 Hobson et al. ..... 428/198
6,555,192 B1 * 4/2003 Tanaka et al. ..... 428/40.1
7,471,924 B2 * 12/2008 Shigezaki et al. ..... 399/349
2005/0074251 A1 * 4/2005 Katoh et al. ..... 399/68
2007/0020005 A1 * 1/2007 Shigezaki et al. ..... 399/349

FOREIGN PATENT DOCUMENTS

JP 57-151981 A 9/1982
JP 63-21971 U 2/1988
JP 01173084 A * 7/1989
JP 2-150879 A 6/1990
JP 02266383 A * 10/1990

(Continued)

OTHER PUBLICATIONS

English translation of Jinzai (JP pub 05-027639), published Feb. 5, 1993.*

(Continued)

*Primary Examiner*—David M Gray
*Assistant Examiner*—Geoffrey T Evans
(74) *Attorney, Agent, or Firm*—Nixon & Vanderhye, P.C.

(57) ABSTRACT

A cleaning member for cleaning the toner remaining on the outer peripheral surface of a heat roller that fixes an unfixed developer image formed on a sheet of paper onto the paper by heating under pressure, includes: a mesh portion having a predetermined mesh in the area abutting the heat roller. The mesh portion is formed of heat resistant wires.

18 Claims, 9 Drawing Sheets

FOREIGN PATENT DOCUMENTS

| | | | | |
|---|---|---|---|---|
| JP | 03004281 | A | * | 1/1991 |
| JP | 05027639 | A | * | 2/1993 |
| JP | 8-95411 | A | | 4/1996 |
| JP | 2001-83831 | A | | 3/2001 |
| JP | 2006-343546 | A | | 12/2006 |

OTHER PUBLICATIONS

English translation of Menjo (JP 03-004281).*
English translation of Menjo et al. (JP 02-266383).*
English translation of Menjo et al. (JP 01-173084).*

* cited by examiner

FIG. 10

| Paper type | Maker | Basis weight ($g/m^2$) | Thick-ness (μm) | X-ray intensity (kcps) | | | | |
|---|---|---|---|---|---|---|---|---|
| | | | | Main filler | Ca | Al | Cl | Si |
| Paper A | Mitsubishi Paper Mills | 67 | Paper A | $CaCO_3$ | 83.62 | 2.09 | 1.73 | 1.90 |
| Paper B | Oji Paper | 63 | Paper B | $CaCO_3$ | 95.16 | 1.60 | 1.02 | 1.82 |
| Paper C | Boise Cascade (Nekossa) | 74 | Paper C | $CaCO_3$ | 190.20 | 0.58 | 5.63 | 2.88 |
| Paper D | Inter-national (Hammer Mill) | 76 | Paper D | $CaCO_3$ | 265.43 | 0.15 | 5.29 | 0.41 |

FIG. 11

| Paper type | Mesh size | | | |
|---|---|---|---|---|
| | 1.2 mm | 1.4 mm | 1.6 mm | 1.8 mm |
| Paper A | Bad (1) | Good | Excellent | Medium (2) |
| Paper B | Bad (1) | Medium (1) | Excellent | Medium (2) |
| Paper C | Medium (1) | Good | Excellent | Bad (2) |
| Paper D | Medium (1) | Good | Excellent | Bad (2) |

[Evaluation]

Good: good in cleaning performance with no clogging in the mesh portion

Excellent: good in cleaning performance with no clogging in the mesh portion (good also in life performance)

Medium (1): generally good though some paper dust and toner clogged in the mesh portion Medium (2):No paper dust and toner clogged but cleaning deficiency occurred in part Bad (1): Paper dust and toner clogged and some breakage occurred in the mesh portion Bad (2): Cleaning deficiency occurred Print count: 200 K (200,000 sheets) when evaluated.

CLEANING MEMBER AND IMAGE FORMING APPARATUS USING THE SAME

This Nonprovisional application claims priority under 35 U.S.C. §119(a) on two Patent Applications No. 2005-251250 filed in Japan on 31 Aug. 2005 and No. 2005-357263 filed in Japan on 12 Dec. 2005, the entire contents of which are hereby incorporated by reference.

BACKGROUND OF THE INVENTION (1) Field of the Invention

The technology disclosed herein relates to a cleaning member and an image forming apparatus using this, in particular relating to a cleaning member for cleaning developers (toner) and paper dust remaining on the outer peripheral surface of a fixing roller and an image forming apparatus for forming image information on a recording medium by electrophotography wherein the fixing roller is adapted to be cleaned by the cleaning member.

(2) Description of the Prior Art

Recently, in the field of image forming apparatuses based on electrophotography, there has been a trend of the developer (toner) becoming smaller in particle size in order to support high-speed printing jobs and promote improvement in print quality.

For example, high-speed print processing in the image forming apparatus conventionally indicated a printing operation for 40 to 60 sheets per minute for standard paper (A4 short-edge feed). But development into a high-speed, configuration handling 100 or greater sheets per minutes, which used to be the field of mimeograph, is in progress.

In an image forming apparatus supporting high-speed processing, in order to increase the number of processing, the rotational speeds of the photosensitive member etc., and the conveyance speed of recording media have to be made faster than that in the conventional configuration, so the speed should need to be enhanced about 1.5 times as high as the conventional operating speed (about 450 mm/sec at maximum).

However, with the high-speed development of the image forming apparatus, there occur various problems as follows.

For example, concerning paper feed, there occurs a problem of a greater amount of paper dust arising compared to the conventional configuration.

Usually, the paper stored in the paper feed cassette is picked up sheet by sheet by the pickup roller and conveyed passing through the transfer station and the fixing unit by means of feed rollers, then discharged to the paper output tray. In this process, the paper dust that has been tribo-electrified when picked up by the pickup roller separates into two parts, under the influence of the transfer electric field; that is, some paper dust remains on the paper, the other transfers to the photosensitive drum through the transfer station, and these are believed to be the cause of the most of the above problems.

To deal with such paper dust, a proposal (Japanese Patent Application Laid-open 2001-83831) has been proposed which attempts to secure print quality by removing paper particles with a cleaning element on the photosensitive member.

However, in the field of the image forming apparatuses for supporting high-speed operation, there has been a problem in that the ratio (content) of paper particles remaining on the paper and transferring to the photosensitive member by the transfer electric field changes due to high paper feed speed.

More specifically, since the paper passes through the transfer station at high speed in the process of high-speed printing, short fibers of the pulp component (that is the main component of paper dust) are made to transfer to the photosensitive member under the influence of the transfer electric field as in the conventional configuration while the pulp component of relatively long fibers will remain on the paper because of being less affected by the transfer electric field.

On the other hand, in the fixing step (fixing mechanism) as the step after the transfer step, the fixing rollers that constitute the fixing mechanism are rotationally driven by a rotational force from a drive source. The fixing rollers are made up of a heat roller and a pressing roller, and there are cases where tribo-electricity is generated by friction at the nip between these rollers. If the paper carrying paper dust is conveyed into the fixing stage under this condition, paper dust on the paper will transfer to these two rollers.

Incidentally, the developers (unfixed toner) having transferred to the paper contain an increased amount of a lower charged toner component compared to the amount of charge on the toner used in a conventional machine because of execution of high-speed printing operations. This is caused by the fact of high rotational speeds of the rotational bodies in the developing hopper such as an agitating roller, supply roller, developer sleeve etc, and by the fact of the charge on the toner being unable to reach saturation due to lower agitation performance because of increase in toner consumption by high speed printing, and by other reasons.

The visual images (image information) formed on the photosensitive member with such toner suffer from a printing problem in that toner is scattered around image patterns in the print by the transfer electric field.

Since the thus scattered toner is present individually or particle by particle on the paper, this toner is more likely to transfer to the heat roller in the fixing stage, compared to the toner that form a dot consisting of clustered toner particles. This is because toner particles in the cluster that forms a dot exchange heat with each other as receiving heat from the heat roller and join to each other under the fused condition, producing an increased binding force to the paper (an increased sticking effect).

On the other hand, the individual toner particles that will not form a dot also receive the same amount of heat from the fixing roller (heat roller), but are not affected by neighboring toner particles, so that they are fused but cannot reach the level that produces adequate sticking effect hence will transfer to the heat roller side.

In the above way, when excess fiber pulp (paper dust) and toner (developers) adhere to the fixing rollers, there occurs the problem that cleaning load in the cleaning portion of the fixing rollers is increased compared to that in the conventional machine.

In addition, the cleaning configuration for the conventional fixing rollers uses a roller type with a roller of felt and/or metal, a blade type with a blade of heat-resistant hard rubber, or the like. Any of these methods involves insufficient toner collecting performance and the lifetime problem as a cleaning member for the fixing rollers in high-speed machines when considering increase in cleaning quantity and the usage status of the high-speed machine.

SUMMARY OF THE INVENTION

The technology disclosed herein has been devised in view of the above conventional problems, it is therefore an object of the technology disclosed herein to provide a cleaning member which can collect the developer(s) and paper dust (paper dust lumps made of paper dust and toner mixture)

remaining on the fixing roller surface and realize a long life configuration of it as well as providing an image forming apparatus using this.

The image forming apparatus according to the technology disclosed herein for solving the above problems is configured as follows.

A cleaning member defined in the first aspect of the technology disclosed herein is a cleaning member for cleaning a developer remaining on an outer peripheral surface of a fixing roller that fixes an unfixed developer image formed on a recording medium thereto by heating under pressure, comprising: a mesh portion having a predetermined mesh in at least an area abutting the fixing roller, the mesh portion being formed of a heat resistant wire.

In the technology disclosed herein, examples of the developer may include toner used for an image forming apparatus. Examples of the unfixed developer image may include an unfixed toner image electrophotographically formed on the photosensitive drum in an image forming apparatus and transferred to the paper.

The cleaning member defined in the second aspect of the technology disclosed herein is characterized in that, in addition to the configuration described in the first aspect, a mesh size of the mesh portion is specified to be greater than 1.2 mm and smaller than 1.8 mm.

The cleaning member defined in the third aspect of the technology disclosed herein is characterized in that, in addition to the configuration described in the first or second aspect, the mesh portion is arranged so that a plurality of wires come into contact with the fixing roller, cutting across a rotational direction of the fixing roller in the contact area.

In the technology disclosed herein, examples of the configuration of the mesh portion may include one in which a plurality of wires abut the heat fixing roller in each cross-section perpendicular to the rotational direction of the fixing roller and one in which a mesh having a honeycomb pattern made of the plurality of wires is adapted to abut the fixing roller.

The cleaning member defined in the fourth aspect of the technology disclosed herein is characterized in that, in addition to the configuration described in any one of the first through third aspects, when the surface of the fixing roller is formed of a material having resiliency, the wire uses a material having a higher hardness than a surface hardness of the fixing roller.

In the technology disclosed herein, examples of the material having resiliency may include silicone rubber, heat-resistant synthetic rubber etc., and one that is formed with these material so that the fixing roller surface will have resiliency.

The cleaning member defined in the fifth aspect of the technology disclosed herein is characterized in that, in addition to the configuration described in any one of the first through third aspects, when the surface of the fixing roller is formed of a material having no resiliency, the wire uses a material having a lower hardness than a surface hardness of the fixing roller.

In the technology disclosed herein, examples of the material having no resiliency may include metallic material and a hard member that is formed by coating a Teflon (trademark) coating having a high hardness or the like, over the fixing roller surface, and members that are formed by coating the fixing roller surface with these materials.

The cleaning member defined in the sixth aspect of the technology disclosed herein is characterized in that, in addition to the configuration described in any one of the first through fifth aspects, the wire is formed of metal, hard resin fiber, or combination of these.

The cleaning member defined in the seventh aspect of the technology disclosed herein is characterized in that, in addition to the configuration described in any one of the first through sixth aspects, the wire is conductive and has a function of erasing electric potential charged on the fixing roller.

In the technology disclosed herein, the function of erasing the electric potential charged on the fixing roller is to erase the triboelectric potential that is generated by the friction of the rotating fixing roller with the components arranged around the roller, and examples of this may include the grounding of the wires of the mesh portion of the cleaning member abutted on the fixing roller.

The cleaning member defined in the eighth aspect of the technology disclosed herein is characterized in that, in addition to the configuration described in any one of the first through seventh aspects, the cleaning member has a function as a container for storing a developer collected by the mesh portion.

That is, the cleaning member may have a developer collecting portion for storing the collected developer as a part thereof.

The image forming apparatus defined in the ninth aspect of the technology disclosed herein comprises: an electrostatic latent image support for forming a developer image with a developer; a charger for charging a surface of the electrostatic latent image support; a light exposure portion for forming an electrostatic latent image on the surface of the electrostatic latent image support; a developing portion for visualizing the electrostatic latent image formed on the surface of electrostatic latent image support with the developer; a transfer portion for transferring the developer image on the surface of the electrostatic latent image support to a recording medium; a fixing portion for fixing the developer image transferred on the recording medium to the recording medium by a fixing roller; and a cleaning member for cleaning a surface of the fixing roller, wherein the developer image electrophotographically formed on the surface of the electrostatic latent image support is transferred to the recording medium by a transfer electric field and then is fixed to the recording medium, and the cleaning member is any one of the cleaning members defined in the above first to eighth aspects.

The cleaning member defined in the tenth aspect of the technology disclosed herein is characterized in that, in addition to the configuration described in any of the first through ninth aspects, the mesh portion at least varies in mesh size depending on the areas abutting the fixing roller.

The cleaning member defined in the eleventh aspect of the technology disclosed herein is characterized in that, in addition to the configuration described in tenth aspect, the mesh portion is constructed so that the mesh size of the area on a downstream side of a rotation of the fixing roller is greater than the mesh size of the area on an upstream side of the rotation of the fixing roller.

The cleaning member defined in the twelfth aspect of the technology disclosed herein is characterized in that, in addition to the configuration described in eleventh aspect, the mesh portion is constructed so that the mesh size of the area on the upstream side of the rotation of the fixing roller is specified to be greater than 1.2 mm and smaller than 1.5 mm, and the mesh size of the area on the downstream side of the rotation of the fixing roller is specified to be greater than 1.4 mm and smaller than 1.8 mm.

The cleaning member defined in the thirteenth aspect of the technology disclosed herein is characterized in that, in addition to the configuration described in tenth aspect, the mesh portion is constructed so that the mesh size of the area on an upstream side of a rotation of the fixing roller is greater than the mesh size of the area on a downstream side of the rotation of the fixing roller.

The cleaning member defined in the fourteenth aspect of the technology disclosed herein is characterized in that, in addition to the configuration described in thirteenth aspect, wherein the mesh portion is constructed so that the mesh size of the area on the downstream side of the rotation of the fixing roller is specified to be greater than 1.2 mm and smaller than 1.5 mm, and the mesh size of the area on the upstream side of the rotation of the fixing roller is specified to be greater than 1.4 mm and smaller than 1.8 mm.

The cleaning member defined in the fifteenth aspect of the technology disclosed herein is characterized in that, in addition to the configuration described in any one of the tenth through fourteenth aspects, in the areas of the mesh portion different in mesh size, the mesh area of the mesh portion having a smaller mesh size at least collects the developer remaining on the outer peripheral surface of the fixing roller; and the mesh area of the mesh portion having a greater mesh size at least collects a stuck substance including paper dust, adhering on the outer peripheral surface of the fixing roller.

In the technology disclosed herein, the stuck substance adhering on the outer peripheral surface of the fixing roller may include leftover developer(s) or toner, paper dust, dust and dirt contaminated in the leftover developer(s) or toner, buildup lump of leftover developer(s) or toner and the like.

In accordance with the invention defined in the first aspect, as a cleaning member for cleaning the developer remaining on the outer peripheral surface of the fixing roller that fixes an unfixed developer image formed on the recording medium thereto by heating under pressure, the mesh portion having the predetermined mesh made of the plurality of wires is formed in at least the area abutting the fixing roller. Accordingly, the mesh portion comes into area contact with the fixing roller so that it is possible with the plurality of wires to efficiently collect the leftover developer(s) and paper dust remaining on the fixing roller surface. Further, since the mesh portion is formed of the heat-resistant wire, this configuration is markedly effective in withstanding the thermal influence and making the life of the cleaning member longer even when it is used for the cleaning of the fixing roller which is high in temperature.

In accordance with the inventions described in the second to eighth aspects, the following effects can be obtained in addition to the common effect obtained from the invention defined in the first aspect.

In accordance with the second aspect of the technology disclosed herein, specifying the mesh size of the mesh portion formed in the cleaning member to be greater than 1.2 mm and smaller than 1.8 mm, makes it possible to efficiently collect leftover developer(s) and paper dust without causing any clogging in the mesh portion and any cleaning defect.

In accordance with the third aspect of the technology disclosed herein, the mesh portion is arranged so that the plurality of wires come into contact with the peripheral surface of the fixing roller, cutting across the rotational direction of the fixing roller in the contact area. Since this arrangement brings the mesh portion into area contact with the fixing roller, it is possible to clean the fixing roller continuously with the plurality of wires in the contact area. As a result, it is possible to efficiently collect the leftover developer(S) and paper dust.

In accordance with the fourth aspect of the technology disclosed herein, use of the material having a higher hardness than the surface hardness of the fixing roller as the wires when the surface of the fixing roller is formed of the material having resiliency, makes it possible to efficiently collect the leftover developer(S) and paper dust because the wires can be brought into close contact with the fixing roller surface.

In accordance with the fifth aspect of the technology disclosed herein, use of the material having a lower hardness than the surface hardness of the fixing roller as the wires when the surface of the fixing roller is formed of the material having no resiliency, makes it possible to collect the leftover developer(s) and paper dust without damaging the fixing roller surface.

In accordance with the sixth aspect of the technology disclosed herein, formation of the wire with metal, hard resin fiber, or combination of these can realize a long life configuration of the cleaning member.

In accordance with the seventh aspect of the technology disclosed herein, the wire's conductiveness and function of erasing the electric potential make it possible to easily erase the triboelectric potential generated by the friction of the rotating fixing roller with the components arranged around the periphery of the roller by grounding of the wires. As a result, it is possible to prevent adherence of the developer(s) and paper dust due to electrostatic potential, hence efficiently collect the leftover developer(s) and paper dust.

In accordance with the eighth aspect of the technology disclosed herein, since the cleaning member has the function as a container for storing the developer collected by the mesh portion, it is not only possible to collect the developer(s) and paper dust remaining on the fixing roller surface but also store the collected developer(s) and other substances. As a result, it is possible to collect the leftover developer(s) over a long period without the necessity of frequent times of maintenance.

In accordance with the ninth aspect of the technology disclosed herein, in the image forming apparatus comprising: the electrostatic latent image support for forming the developer image with the developer; the charger for charging the surface of the electrostatic latent image support; the light exposure portion for forming the electrostatic latent image on the surface of the electrostatic latent image support; the developing portion for visualizing the electrostatic latent image formed on the surface of electrostatic latent image support with the developer; the transfer portion for transferring the developer image on the surface of the electrostatic latent image support to the recording medium; the fixing portion for fixing the developer image transferred on the recording medium to the recording medium by the fixing roller; and the cleaning member for cleaning the fixing roller surface, wherein the developer image electrophotographically formed on the surface of the electrostatic latent image support is transferred to the recording medium by the transfer electric field and then is fixed to the recording medium, any one of the cleaning members defined in the above first to eighth aspects is used as the cleaning member. Hence, this configuration is effective in providing an image forming apparatus which can efficiently collect the developer(s) and paper dust remaining on the fixing roller surface, withstand the thermal influence and make the life of the cleaning member longer even when it is used for the cleaning of the fixing roller which is high in temperature.

In accordance with the inventions described in the tenth to fifteenth aspects, the following effects can be obtained in addition to the common effect obtained from the invention defined in the first aspect.

That is, in accordance with the invention defined in the tenth aspect, since the mesh portion at least varies in mesh size depending on the areas abutting the fixing roller, it is possible to collect stuck substances, different in size, and adhering on the outer peripheral surface of the fixing roller, e.g., leftover developer, paper dust, mixture of paper dust and dirt contaminated in the leftover developer and the like, separately depending on the mesh size. It is hence possible to collect the remaining particles efficiently without causing any clogging in the mesh portion and any cleaning defects.

In accordance with the eleventh aspect of the technology disclosed herein, since the mesh portion is constructed so that the mesh size of the area on the downstream side of the rotation of the fixing roller is greater than the mesh size of the area on the upstream side of the rotation of the fixing roller, a small-sized leftover particle, i.e., the developer can be collected by the area on the upstream side of the rotation of the fixing roller while a large-sized stuck substance such as large paper dust and dirt, which have not been collected by the area on the upstream side of the rotation of the fixing roller can be collected by the area on the downstream side of the rotation of the fixing roller. Accordingly, it is possible to efficiently collect waste particles without causing any clogging in the mesh portion.

In accordance with the twelfth aspect of the technology disclosed herein, since the mesh portion is constructed so that the mesh size of the area on the upstream side of the rotation of the fixing roller is specified to be greater than 1.2 mm and smaller than 1.5 mm, and the mesh size of the area on the downstream side of the rotation of the fixing roller is specified to be greater than 1.4 mm and smaller than 1.8 mm, it is possible to collect a small-sized leftover particle, i.e., the developer(s) by the area on the upstream side of the rotation of the fixing roller and collect a large-sized stuck substance such as paper dust and dirt, which have not been collected by the area on the upstream side of the rotation of the fixing roller by the area on the downstream side of the rotation of the fixing roller.

In accordance with the thirteenth aspect of the technology disclosed herein, since the mesh portion is constructed so that the mesh size of the area on the upstream side of the rotation of the fixing roller is greater than the mesh size of the area on the downstream side of the rotation of the fixing roller, the stuck substance of greater size than the developer, such as paper dust, dirt etc., can be collected together with leftover developer in the area on the upstream side of the rotation of the fixing roller while the stuck substance of small size such as leftover developer, dust and etc., which was not collected and has leaked out through the mesh portion in the area located on the upstream of the rotation of the fixing roller can be collected by the area on the downstream side of the rotation of the fixing roller where the mesh size is small. Accordingly, it is possible to efficiently collect waste particles without causing any clogging in the mesh portion.

In accordance with the fourteenth aspect of the technology disclosed herein, since the mesh portion is constructed so that the mesh size of the area on the downstream side of the rotation of the fixing roller is specified to be greater than 1.2 mm and smaller than 1.5 mm, and the mesh size of the area on the upstream side of the rotation of the fixing roller is specified to be greater than 1.4 mm and smaller than 1.8 mm, the stuck substance of greater size than the developer, such as paper dust, dirt etc., can be collected together with the leftover developer in the area on the upstream side of the rotation of the fixing roller while the stuck substance of small size such as the leftover developer, dust and etc., which was not collected and has leaked out through the mesh portion in the area located on the upstream of the rotation of the fixing roller can be positively collected by the area on the downstream side of the rotation of the fixing roller where the mesh size is small.

In accordance with the fifteenth aspect of the technology disclosed herein, since in the areas of the mesh portion different in mesh size, the mesh area of the mesh portion having a smaller mesh size at least collects the leftover developer on the outer peripheral surface of the fixing roller; and the mesh area of the mesh portion having a greater mesh size at least collects the stuck substance including paper dust adhering on the outer peripheral surface of the fixing roller, it is possible to collect stuck substances such as the leftover developer(s), paper dust etc., stuck to the outer peripheral surface of the fixing roller, at different positions, depending on their size, hence it is possible to collect waste particles without causing clogging in the mesh portion.

BRIEF DESCRIPTION OF THE DRAWINGS

FIG. 10 is a paper comparison table showing data of paper types used in the present embodiment; and FIG. 11 is an evaluation table showing evaluation on cleaning when different kinds of paper are used with different mesh sizes of the mesh portion in the cleaning member according to the present embodiment.

DESCRIPTION OF THE PREFERRED EMBODIMENTS

Example embodiments will hereinafter be described in detail with reference to the drawings.

Figure 1:
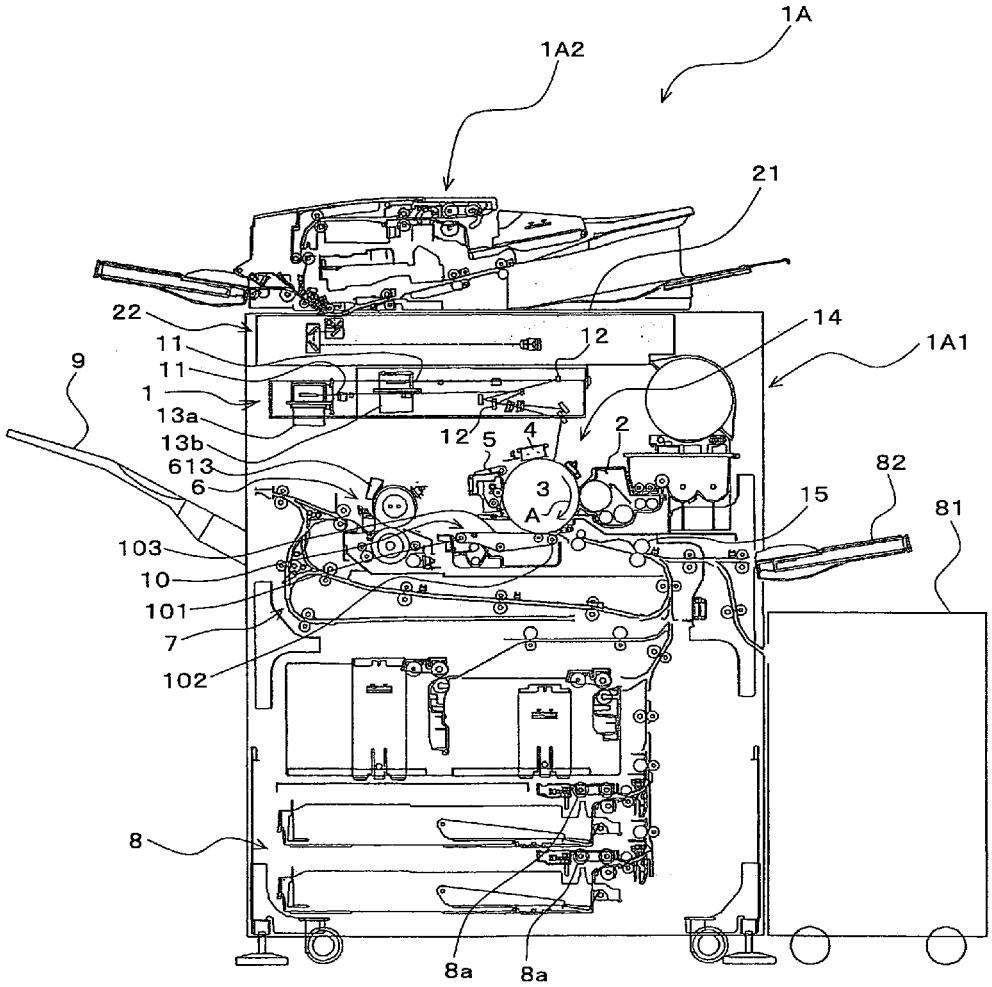
FIG. 1 is an illustrative view showing an overall configuration of an image forming apparatus according to an example embodiment.
Figure 2:
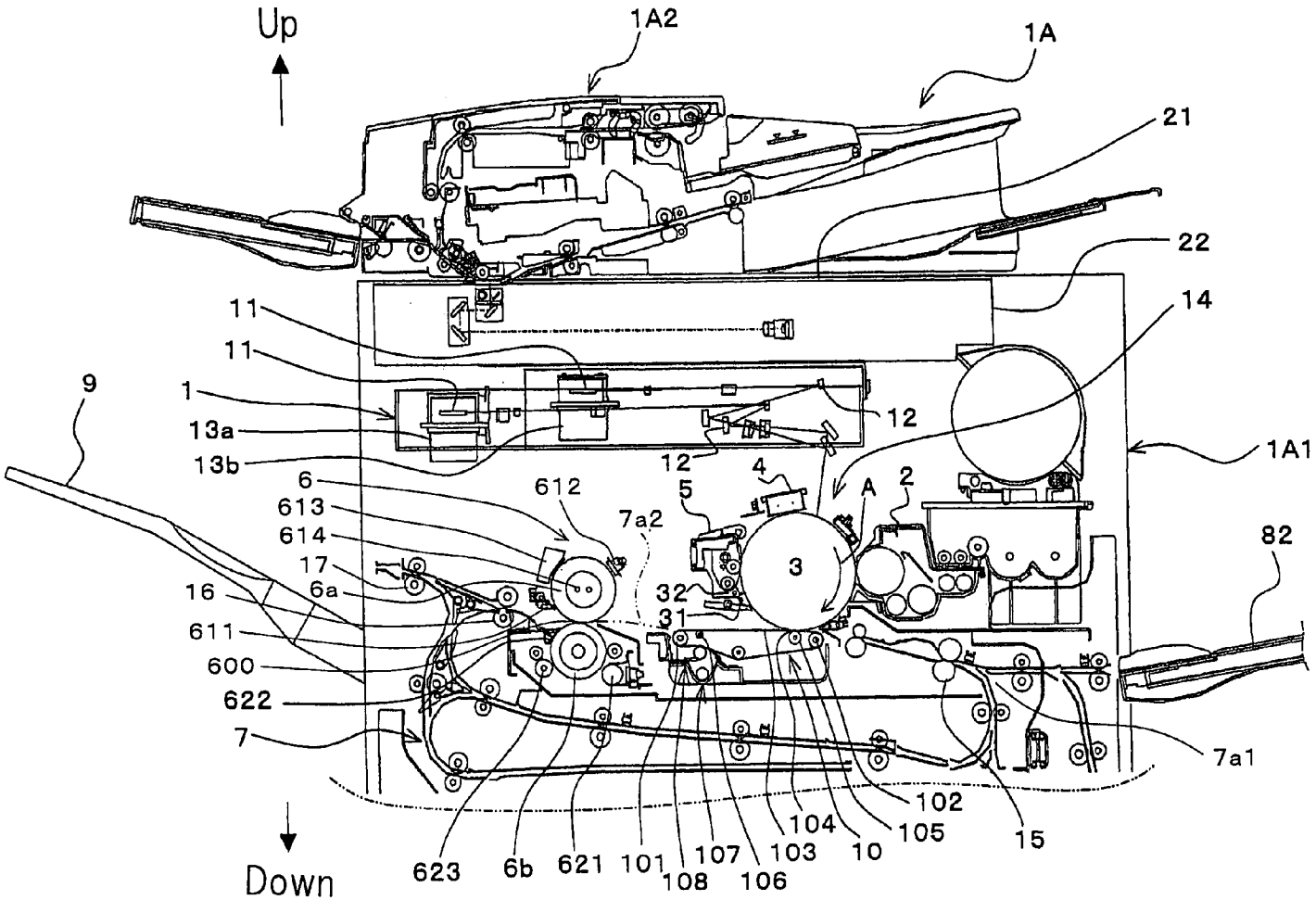
FIG. 2 is a detailed view showing part of the configuration of the apparatus body of the image forming apparatus.

FIGS. 1 and 2 show one example embodiment. FIG. 1 is an illustrative view showing the overall configuration of an image forming apparatus according to the embodiment of the present invention, and FIG. 2 is a partial detailed view showing the configuration of the apparatus body of the image forming apparatus.

An image forming apparatus 1A according to the present embodiment is an image forming apparatus that forms and outputs a monochrome image of externally transferred image data, on a predetermined sheet of recording material (hereinbelow referred to as paper) as a recording medium by electrophotography, wherein a cleaning member according to the technology disclosed herein is adopted as a cleaning member for cleaning the leftover developers on the peripheral surface of fixing rollers for heating and pressurizing unfixed toner (developers) image formed on the paper so as to fix the image on the paper.

To begin with, the overall configuration of image forming apparatus 1A according to the present embodiment will be described with reference to the drawings.

Image forming apparatus 1A essentially comprises, as shown in FIGS. 1 and 2, an apparatus body 1A1 including a light exposure unit (light exposure means) 1, a developing unit (developing means) 2, a photosensitive drum (electrostatic latent image support) 3, a charger (charging means) 4, a cleaner unit 5, a fixing unit (fixing means) 6, a paper feed path 7, a paper feed tray 8, a paper output tray 9, a transfer device (transfer means) 10 and the like, and an automatic document processor 1A2.

Formed on the top surface of apparatus body 1A1 is an original placement table 21 comprised of transparent glass on which a document is placed. An automatic document processor 1A2 is arranged on top of this original placement table 21 so that it can pivotally open upwards while a scanner portion 22 as a document reader for reading image information of originals is laid out under this original placement table 21.

Arranged below scanner portion 22 are light exposure unit 1, developing unit 2, photosensitive drum 3, charger 4, cleaner unit 5, fixing unit 6, paper feed path 7, paper output tray 9 and transfer device 10. Further, paper feed tray 8 for accommodating paper is arranged under these components.

Light exposure unit 1 provides a function of an emitting laser beam in accordance with the image data (print image information) output from an unillustrated image processor to irradiate the surface of photosensitive drum 3 that has been uniformly charged by charger 4 so as to write and form an electrostatic latent image corresponding to the image data on the surface of photosensitive drum 3.

Light exposure unit 1 is arranged directly under scanner portion 22 and above photosensitive drum 3, and includes laser scanning units (LSUs) 13*a* and 13*b* each having a laser emitter 11 and a reflection mirror 12. In the present embodiment, in order to achieve high-speed printing operation, a method for alleviating the rush of irradiation timings by using a plurality of laser beams, namely a two-beam method, is adopted.

In the present embodiment laser scanning units (LSUs) 13*a* and 13*b* are used for light exposure unit 1, but an array of light emitting elements, e.g., an EL or LED writing head may be used.

Photosensitive drum 3 has a cylindrical shape and arranged under light exposure unit 1 as shown in FIG. 2 and is controlled so as to rotate in a predetermined direction (in the direction of arrow A in the drawing) by an unillustrated drive means and control means. Arranged starting from the position at which image transfer ends downstream in the rotational direction of the photosensitive drum along the outer peripheral surface of this photosensitive drum 3 are a paper separation claw (recording medium separation member) 31, cleaner unit 5, charger 4 as an electric field generator and developing unit 2, in the order mentioned.

Paper separation claw 31 is disposed so as to be moved into and out of contact with the outer peripheral surface of photosensitive drum 3 by means of a solenoid (separator drive means) 32. When this paper separation claw 31 is put in abutment with the outer peripheral surface of photosensitive drum 3, it functions to peel off the paper that has adhered to the photosensitive drum 3 surface during the unfixed toner image on photosensitive drum 3 being transferred to the paper.

As a drive means for paper separation claw 31, a drive motor or the like may be used instead of solenoid 32, or any other drive means may be also selected.

Developing unit 2 visualizes the electrostatic latent image formed on photosensitive drum 3 with black toner, and is arranged at approximately the same level at the side (on the right side in the drawing) of photosensitive drum 3 downstream of charger 4 with respect to the rotational direction of the photosensitive drum (in the direction of arrow A in the drawing). A pair of registration rollers 15 is disposed under this developing unit 2 on the upstream side in the recording medium feed direction.

The pair of registration rollers 15 is operated and controlled by an unillustrated drive means and control means so as to convey the paper delivered from paper feed tray 8 into and between photosensitive drum 3 and a transfer belt 103 while making the leading end of the paper adjust to the toner image on the photosensitive drum 3.

Charger 4 is a charging means for uniformly charging the photosensitive drum 3 surface at a predetermined potential, and is arranged over photosensitive drum 3 and close to the outer peripheral surface thereof.

A discharge type charger 4 is used in the present embodiment, but a contact roller type or a brush type may be used.

Cleaning unit 5 removes and collects the toner left on the surface of photosensitive drum 3 after development and image transfer, and is disposed at approximately the same level at the side of photosensitive drum 3 (on the left side in the drawing), on the approximately opposite side across photosensitive drum 3 from developing unit 2.

As described above, the visualized electrostatic image on photosensitive drum 3 is transferred to the paper being conveyed as transfer device 10 applies an electric field having an opposite polarity to that of the electric charge of the electrostatic image to the paper.

For example, when the electrostatic image bears negative (−) charge, the applied polarity of transfer device 10 should be positive (+).

As shown in FIG. 2, transfer device 10 is provided as a transfer belt unit form in which a transfer belt 103 having a predetermined resistivity (ranging from $1\times10^{9}$ to $1\times10^{13}$ Ω·cm in the embodiment) is wound and tensioned on a drive roller 101, a driven roller 102 and other rollers, and is disposed under photosensitive drum 3 with the transfer belt 103 surface put in contact with part of the outer peripheral surface of photosensitive drum 3. This transfer belt 103 conveys the paper while pressing the paper against photosensitive drum 3.

Other than drive roller 101 and driven roller 102, an elastic conductive roller 105 capable of applying a transfer electric field is laid out at a contact point 104 where transfer belt 103 comes into contact with photosensitive drum 3.

Elastic conductive roller 105 is composed of a soft material such as elastic rubber, foamed resin etc. Since this elasticity of elastic conductive roller 105 permits photosensitive drum 3 and transfer belt 103 to come into, not line contact, but area contact of a predetermined width (called a transfer nip) with each other, it is possible to improve the efficiency of transfer to the paper that is conveyed.

Further, a charge erasing roller 106 for erasing the electric field applied as the paper being conveyed through the transfer area so as to achieve smooth conveyance of the paper to the subsequent stage is disposed on the interior side of transfer belt 103, on the downstream side, with respect to the direction of paper conveyance, of the transfer area of transfer belt 103.

Transfer device 10 further includes a cleaning unit 107 for removing dirt due to leftover toner on transfer belt 103 and a plurality of charge erasing devices 108 for erasing electricity on transfer belt 103. Erasure of charge by erasing devices 108 may be performed by grounding via the apparatus or by positively applying charge of a polarity opposite to that of the transfer field.

The paper with the static image (unfixed toner) transferred thereon by transfer device 10 is conveyed to fixing unit 6, where it is pressed and heated so as to fuse the unfixed toner and fix it to the paper.

Fixing unit (fixing rollers) 6 includes, as shown in FIG. 2, a heat roller 6*a* and a pressing roller 6*b*, and fuses and fixes the toner image transferred on the paper, by rotating heat roller 6*a* so as to convey the paper held between heat roller 6*a* and pressing 6*b*, through the nip between heat roller 6*a* and pressing roller 6*b*.

Arranged on the downstream side of fixing unit 6 with respect to the direction of paper conveyance is a conveyance roller 16 for conveying the paper.

Heat roller 6*a* has a sheet separation claw 611, a roller surface temperature detector (thermistor) 612 and a cleaning member 613 arranged on the outer periphery thereof and has a heat source 614 for heating the heat roller surface at a predetermined temperature (set fixing temperature: approximately 160 to 200 deg. C.) provided in the interior part thereof.

Heat roller 6*b* is provided at its each end with a pressing element 621 capable of abutting the pressing roller 6*b* with a predetermined pressure against heat roller 6*a*. In addition a sheet separation claw 622 and a roller surface cleaning element 623 are provided on the outer periphery of pressing roller 6*b*, similarly to the outer periphery of heat roller 6*a*.

In this fixing unit 6, as shown in FIG. 2 the unfixed toner on the paper being conveyed is heated and fused by heat roller 6*a*, at the pressurized contact portion (so-called fixing nip portion) 600 between heat roller 6*a* and pressing roller 6*b*, so that the unfixed toner is fixed to the paper by the sticking effect to the paper by the pressing force from heat roller 6*a* and pressing roller 6*b*.

Paper feed tray 8 stacks a plurality of sheets (paper) to which image information will be output (printed), and is arranged under an image forming portion 14 made up of light exposure unit 1, developing unit 2, photosensitive drum 3, charger 4, cleaning unit 5, fixing unit 6 etc. A paper pickup roller 8*a* is disposed at an upper part on the paper delivery side of this paper feed tray 8 (see FIG. 1).

This paper pickup roller 8*a* picks up the paper, sheet by sheet, from the topmost of a stack of paper stored in paper feed tray 8, and conveys the paper downstream (for convenience sake, the delivery side of the paper (the cassette side) is referred to as upstream and the direction of conveyance is referred to as downstream) to the registration rollers (also called "idle rollers") 15 side in paper feed path 7.

Since the image forming apparatus 1A according to the present embodiment is aimed at performing high-speed printing operations, a plurality of paper feed trays 8 each capable of stacking 500 to 1500 sheets of standard-sized paper are arranged under image forming portion 14. Further, a large-capacity paper feed cassette 81 capable of storing a plurality kinds of paper in large volumes is arranged at the side of the apparatus while a manual feed tray 82 for mainly supporting printing etc. for irregular sized paper is arranged on the top of the large-capacity paper feed cassette 81.

Paper output tray 9 is arranged on the opposite side across the apparatus from that of manual feed tray 82. It is also possible to configure such a system that instead of paper output tray 9, a post-processing machine for output paper (machine for stapling, punching and other processes) and/or a multi-bin paper output tray etc., may be arranged as an option.

Paper feed path 7 is laid out between the aforementioned photosensitive drum 3 and paper feed tray 8, and conveys the paper supplied from paper feed tray 8, sheet by sheet to transfer device 10 where a toner image is transferred from photosensitive drum 3 to the paper, further conveys it to fixing unit 6 where the unfixed toner image is fixed to the paper, then conveys the sheet as it is being guided by paper feed paths and branch guides which are set in the designated processing mode.

Now, paper feed path 7 will be described in detail with reference to the drawings.

Figure 3:
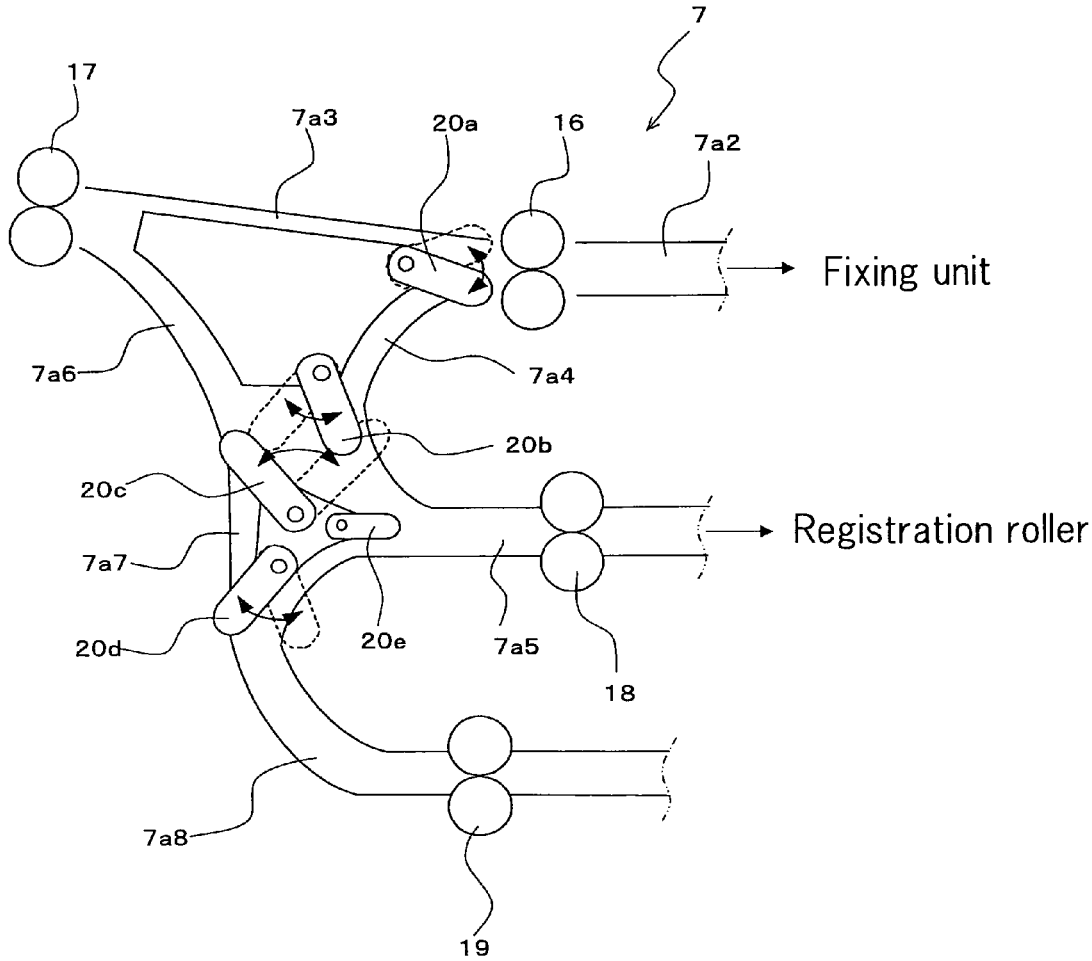
FIG. 3 is a detailed view showing part of the configuration of paper feed paths and branch guides for connection therebetween in the image forming apparatus.

FIG. 3 is a detailed view showing part of the configuration of paper feed paths and branch guides for connection therebetween in the image forming apparatus according to the present embodiment.

As shown in FIGS. 2 and 3, paper feed path 7 is mainly composed of a first paper feed path 7*a*1 extending from paper feed tray 8 to registration rollers 15, a second paper feed path 7*a*2 extending from registration rollers 15 and passing through transfer device 10 and fixing unit 6 to a pair of conveyance rollers 16 on the downstream side, a third paper feed path 7*a*3 extending from conveyance rollers 16 to a pair of paper discharge rollers 17 for discharging paper to paper output tray 9, a fourth paper feed path 7*a*4 for inverting paper P from conveyance rollers 16, a fifth paper feed path 7*a*5 connected to fourth paper feed path 7*a*4 and extending to a pair of inversion conveyance rollers 18 for re-feeding paper P to registration rollers 15, a sixth paper feed path lab 7*a*6 for conveying paper P in reverse from paper discharge rollers 17, a seventh paper feed path 7*a*7 connected to the sixth paper feed path and avoiding entrance to fifth paper feed path 7*a*5 and an eighth paper feed path 7*a*8 connected to seventh paper feed path 7*a*7 and extending to a pair of switchback rollers 19.

Further, a plurality of branch guides for switching the conveyance route of paper P by selecting the paper feed path in accordance with the selected processing mode are arranged at branch points.

As shown in FIG. 3, a branch guide 20*a* that selects connection to third paper feed path 7*a*3 or fourth paper feed path 7*a*4 is pivotably arranged at a point downstream of conveyance rollers 16. This branch guide 20*a* is operated by an unillustrated solenoid.

A branch guide 20*b* that connects fourth paper feed path 7*a*4 with fifth paper feed path 7*a*5 or fifth paper feed path 7*a*5 with sixth paper feed path 7*a*6 is pivotably arranged on the downstream side of fourth paper feed path 7*a*4. This branch guide 20*b* is operated by the elastic force of an unillustrated spring member and the rigidity of paper P.

A branch guide 20*c* that selects connection to fifth paper feed path 7*a*5 or seventh paper feed path 7*a*7 is pivotably arranged on the downstream side of sixth paper feed path 7*a*6. This branch guide 20*c* is operated by an unillustrated solenoid.

A branch guide 20*d* that connects seventh paper feed path 7*a*7 with eighth paper feed path 7*a*8 or fifth paper feed path 7*a*5 with eighth paper feed path 7*a*8 is pivotably arranged on the downstream side of seventh paper feed path 7*a*7. This branch guide 20*d* is operated by an unillustrated solenoid.

A branch guide 20*e* for assuring smooth connection from fourth paper feed path 7*a*4 or eighth paper feed path 7*a*8 to fifth paper feed path 7*a*5 is arranged on the upstream side of fifth paper feed path 7*a*5.

With the thus configured paper feed path 7, branch guides 20*a* to 20*d* are operated in accordance with the requested processing mode, whereby it is possible to select a conveyance route of paper P corresponding to the processing mode.

Next, the paper conveyance operations corresponding to processing modes of image forming apparatus 1A will be described with reference to the drawings.

As shown in FIG. 2, the paper P that corresponds to the print request is selected from a plurality of paper feed trays 8 and is conveyed by conveyance rollers in paper feed path 7 to registration rollers 15.

The paper P that has reached registration rollers 15 temporarily stops and is delivered to transfer device 10 by restarting rotation of the registration rollers at such a timing as to make the leading end of paper P adjust to the image information on the photosensitive drum 3, whereby the unfixed toner image (image information) is transferred from photosensitive drum 3 to paper P, then the toner image is fixed to the paper P by fixing unit 6 so that the paper is discharged to paper output tray 9.

With this paper feed path 7, different routes or ways of conveyance are taken after fixing unit 6 up to paper output tray 9, depending on the functional modes (copy mode, printer mode, FAX mode) of image forming apparatus 1A and the print processing modes (one-sided printing, duplex printing).

In the copier mode, the user usually operates the image forming apparatus 1A on site, so that the paper is generally adapted to be output "faceup", that is, the paper is discharged with its printed face up.

In contrast, in the printer and FAX modes, the user is not present near image forming apparatus 1A, so the paper is generally adapted to be output "facedown", that is, the paper P is discharged in the collated order.

Accordingly, image forming apparatus 1A is configured so that the paper P having passed through fixing unit 6 is conveyed along a plurality of conveyance paths through a plurality of branch guides and output to paper output tray 9 in the function-oriented manner.

(Faceup Output with One-Sided Printing)

In image forming apparatus 1A, in an output mode in which paper P is printed on its one side and discharged faceup, immediately before the paper P having passed through fixing unit 6 enters conveyance rollers 16, branch guide 20*a* is actuated by an unillustrated guide position changeover means (solenoid etc.) to open third paper feed path 7*a*3 and close fourth paper feed path 7*a*4.

The paper P being conveyed advances with its leading part navigated by branch guide 20*a*, passing through third paper feed path 7*a*3 and is discharged by means of paper discharge rollers 17 to paper output tray 9.

(Facedown Output with One-Sided Printing)

In image forming apparatus 1A, in an output mode in which paper P is printed on its one side and discharged facedown, immediately before the paper P having passed through fixing unit 6 enters conveyance rollers 16, branch guide 20*a* is actuated by an unillustrated guide position changeover means (solenoid etc.) to open fourth paper feed path 7*a*4 and close third paper feed path 7*a*3.

Further, branch guide 20*c* is actuated by an unillustrated guide position changeover means to open fifth paper feed path 7*a*5 and close seventh paper feed path 7*a*7.

The paper P being conveyed advances with its leading part navigated by branch guide 20*a*, passing through fourth paper feed path 7*a*4 and pushes away branch guide 20*b* by the rigidity of the leading end of paper P and conveyance force to open fifth paper feed path 7*a*5, then is navigated by branch guide 20*c* into fifth paper feed path 7*a*5.

When the rear end of paper P reaches the position of branch guide 20*e*, conveyance of paper P is halted.

Branch guide 20*c* is actuated by an unillustrated guide position changeover means to open sixth paper feed path 7*a*6 and close seventh paper feed path 7*a*7.

At this point, branch guide 20*b* moves by itself by an elastic member (spring etc.) disposed on an unillustrated branch guide support shaft so as to close fourth paper feed path 7*a*4.

Then, inversion conveyance rollers 18 rotate in reverse so as to restart conveyance of paper P. The paper P being conveyed advances with its rear end residing at the position of branch guide 20*e* first, passing through sixth paper feed path 7*a*6 and is output by way of paper discharge rollers 17 to paper output tray 9.

(Output in Duplex Printing Mode)

When duplex printing is performed in image forming apparatus 1A, immediately before the paper P having the first print face (front side print) printed and passed through fixing unit 6 enters conveyance roller 16, branch guide 20*a* is actuated by an unillustrated guide position changeover means (solenoid etc.) to open fourth paper feed path 7*a*4 and close third paper feed path 7*a*3.

Further, branch guide 20*c* is actuated by an unillustrated guide position changeover means to open seventh paper feed path 7*a*7 and close fifth paper feed path 7*a*5. Branch guide 20*d* is also actuated by an unillustrated guide position changeover means to open eighth paper feed path 7*a*8.

The paper P being conveyed advances with its leading part navigated by branch guide 20*a*, passing through fourth paper feed path 7*a*4 and pushes away branch guide 20*b* by the rigidity of the leading end of paper P and conveyance force, then is navigated by branch guide 20*c* to be lead to seventh paper feed path 7*a*7 and further to eighth paper feed path 7*a*8.

When the rear end of paper P arrives at eighth paper feed path 7*a*8, conveyance of paper P halts (the completion of the first side switchback). Thereafter, as branch guide 20*d* is actuated by an unillustrated guide position changeover means to close seventh paper feed path 7*a*7 and open the conveyance path to branch guide 20*e*, switchback roller 19 rotates in reverse to restart conveyance of paper P.

The paper P being conveyed advances with its rear end residing at the position in eighth paper feed path 7*a*8 first, passing through branch guide 20*e* and fifth paper feed path 7*a*5, and is conveyed to registration rollers 15 which is located right before the printing stage (transfer step in the transfer device).

Thereafter, the second side printing of paper P (rear side printing) is performed. The paper P then passes through fixing unit 6 and is conveyed in the same manner as described in the above "Faceup output with one-sided printing" section and is discharged to paper output tray 9.

Next, the control system of image forming apparatus 1A according to the present embodiment will be described in detail with reference to the drawings.

Figure 4:
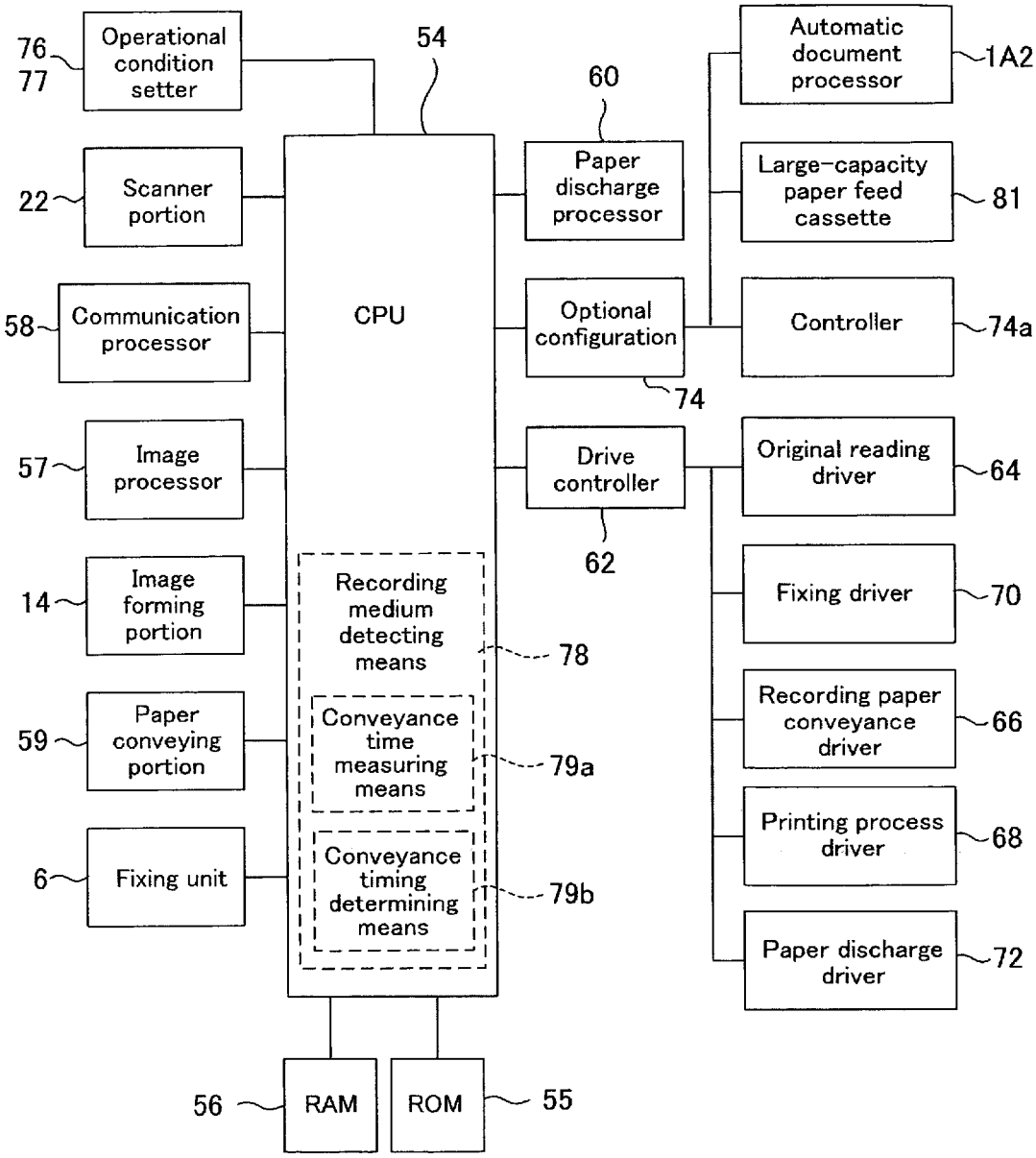
FIG. 4 is a block diagram showing an electric controller configuration in the image forming apparatus.

FIG. 4 is a block diagram showing an electric controller configuration of the image forming apparatus according to the present embodiment.

As shown in FIG. 4, the image forming apparatus 1A according to the embodiment performs processes such as image reading, image processing, image forming and conveyance of paper P, etc., by a central processing unit (CPU) 54 which performs control in accordance with the program stored beforehand in a ROM (read only memory) 55, using temporal storage such as a RAM (random access memory) 56 etc.

It is also possible to use other storage means such as a HDD (hard disk drive) etc., instead of ROM 55 and RAM 56.

In image forming apparatus 1A, the image information of an original (original image data) captured by scanner portion (original reading portion) 22, or original image information transmitted from other terminal devices connected on an unillustrated communication network, is adapted to be input to an image processing portion 57 by way of a communication processor 58.

Image processor 57 shapes the original image information stored in the storage such as RAM 56 or the like into a printing image that is suitable for printing (image forming onto paper), in accordance with the aforementioned program.

The printing image information is input to image forming portion 14.

Image forming portion 14, paper conveying portion (performing various detections and controls of the paper in paper feed path 7 etc.) 59, fixing unit 6 and paper discharge processor (performing various detections and controls of the paper in paper discharge rollers 17) 60 are linked with respective components of drive controller 62.

The paper conveyed by a paper conveying portion 59 advances through the printing stage (the printing process of image information in image forming portion 14) and then a fixing stage (fixing unit 6) for the paper having been processed with printing and is discharged to the paper discharge portion (paper output tray 9).

Paper conveying portion 59 is adapted to receive detection signals from an unillustrated pre-registration detection switch, fixing detection switch, paper discharge detecting switch and the like.

The pre-registration detection switch is a switch that detects whether the paper reaches registration rollers 15. The fixing detection switch is a switch that detects whether the paper reaches fixing unit 6. The paper discharge detecting switch is a switch that detects whether the paper has been discharged.

Image forming apparatus 1A further has an operational condition setter 77.

This operational condition setter 77 sets up operational conditions for image forming and conveyance conditions etc., in image forming apparatus 1A, in accordance with the image forming request and the image forming conditions such as the type of recording media (paper) etc., designated by the user through control switches 76.

Further, in image forming apparatus 1A, based on the set operating conditions, drive controller 62 is adapted to control the drive actuators for the reading portion (scanner portion 22), paper conveying portion 59, image forming portion 14, fixing unit 6, paper discharge processor 60 etc., namely, an original reading driver 64, a paper conveyance driver 66, a printing process driver 68, a fixing driver 70 and a paper discharge driver 72 so that they can operate in synchronization with instructions from CPU 54 in accordance with the program stored in ROM 55.

Original reading driver 64 is a drive actuator for the scan unit 22.

Paper conveyance driver 66 means paper conveying portion 59, specifically, drive motors for paper pickup roller 8*a* and registration rollers 15 along the aforementioned paper feed path 7.

Printing process driver 68 is a drive motor for photosensitive drum 3.

Fixing driver 70 is of drive motors for heat roller 6*a* and pressing roller 6*b* in fixing unit 6.

Paper discharge driver 72 is of drive motors for paper discharge roller 17, etc.

The drive motors for all these drivers may be provided as common or different drive motors with appropriate power transmission mechanisms.

Further, image forming apparatus 1A may be used with optional configurations 74 including post-processors (stapler, puncher, multi-bin paper output trays, shifter, etc.), automatic document reader (automatic document processor 1A2 etc.), large-volume paper feed cassette 81 and the like. These optional configurations 74 incorporate individual controllers 74*a* separately from the controller of image forming apparatus 1A so that each processor can operate in synchronization with the main apparatus by performing timing adjustment via the aforementioned communication processor 58.

A recording medium detecting means 78 detects arrival of the leading end of the paper at fixing unit 6 or the output portion.

Specifically, recording medium detecting means 78 includes: a conveyance time measuring means 79*a* for measuring the time of conveyance of the paper from when the paper is delivered from registration rollers 15 at the entrance of paper feed path 7 where the paper is introduced; and a conveyance timing determining means 79*b* for determining the timings at which the paper is conveyed in paper feed path 7, based on the distance from registration rollers 15 to fixing unit 6 to be controlled, the distance from registration rollers 15 to discharge rollers 17 to be controlled and the conveyance speed of paper.

Recording medium detecting means 78 is adapted to detect the timings at which the paper arrives at (enter) fixing unit 6 and paper discharge roller 17 based on the conveyance timing of recording medium determining by conveyance timing determining means 79*b*.

Next, cleaning member 613 according to the present embodiment will be described in detail with reference to the drawings.

Figure 5:
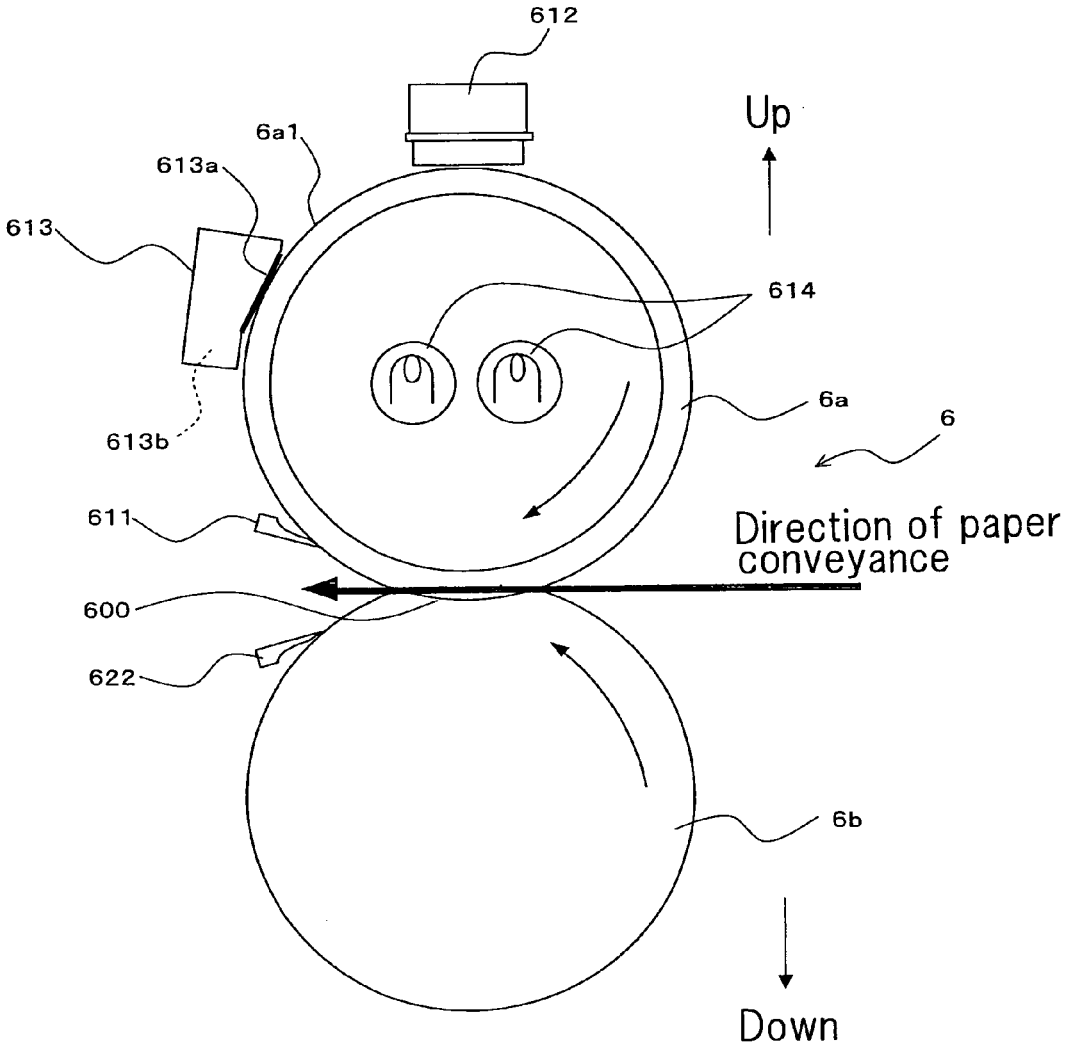
FIG. 5 is a schematic illustrative view showing a configuration of a fixing unit and a cleaning member as the constituents of the image forming apparatus.
Figure 6A:
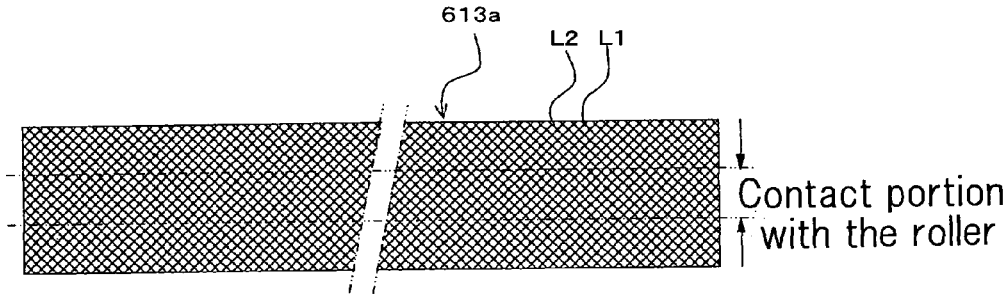
FIG. 6A is an illustration showing one example of a mesh portion for the cleaning member and FIG. 6B is a detailed illustration showing the mesh of the mesh portion.
Figure 6B:
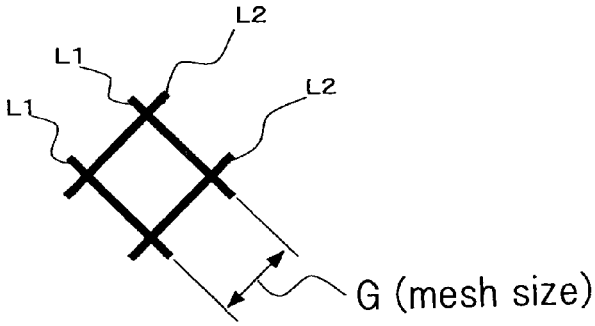

FIG. 5 is a schematic illustrative view showing the configuration of a fixing unit and cleaning member of the present invention; and FIG. 6A is an illustrative view showing one example of a mesh portion as a part of the cleaning member and FIG. 6B is a detailed description of the mesh size of the mesh portion.

Cleaning member 613 has a laterally long box-shaped configuration having a side section of an approximately rectangular (trapezoidal) shape, as shown in FIG. 5, and is integrally composed of a mesh portion 613*a* arranged at vertically upper part thereof for collecting leftover toner from heat roller 6*a* and a toner collecting portion 613*b* arranged below the mesh portion 613*a* for storing the collected toner, and extended along the axial direction of heat roller 6*a*.

In the present embodiment, cleaning member 613 is disposed on the left side of heat roller 6*a* in the drawing. Since in the present embodiment, heat roller 6*a* rotates clockwise in the drawing, the outer peripheral surface, designated at 6*a*1, of heat roller 6*a* moves from bottom to top with respect to cleaning member 613. That is, the lower side of cleaning member 613 is the upstream side of rotation of heat roller 6*a* and the upper side is the downstream side of the rotation.

As shown in FIGS. 5, 6A and 6B, mesh portion 613*a* comprises a plurality of heat-resistant wires crisscrossed with a predetermined mesh (grid mesh) G, and is arranged so that the wires oppose, and are put in contact with, peripheral surface 6*a*1 of heat roller 6*a*, running across the rotational direction of the heat roller 6*a*. The mesh configuration of mesh portion 613*a* is formed lattice-like so that slanted lines L1 and L2 are crisscrossed to each other.

The mesh size G of mesh portion 613*a* is specified to be greater than 1.2 mm and smaller than 1.8 mm, so that the mesh portion 613*a* can collect leftover toner and prevents the collected toner from escaping through mesh portion 613*a*.

It should be noted that the mesh configuration of mesh portion 613*a* is not limited to a lattice pattern but may have a configuration in which a plurality of wires are crossed forming a honeycomb pattern, for example.

Since heat roller 6*a* is formed of a metallic material (member having no resiliency) with a high surface hardness, the wire constituting mesh portion 613*a* is formed of conductive hard resin fiber having a lower hardness (softer) than the surface hardness of heat roller 6*a*.

This mesh portion 613*a* is grounded to the apparatus chassis (not shown), so that electrostatic charge (potential) arising on heat roller 6*a* is grounded to the chassis by way of mesh portion 613*a*.

Toner collecting portion 613*b* is formed at the bottom side of mesh portion 613*a*.

Toner collecting portion 613*b* is formed in a box shape projected downward so that the toner collected by mesh portion 613*a* can be stored in the bottom of cleaning member 613.

Next, cleaning advantage depending on the mesh size (grid size) of mesh portion 613*a* in the present embodiment will be described with reference to the drawings.

Figure 7:
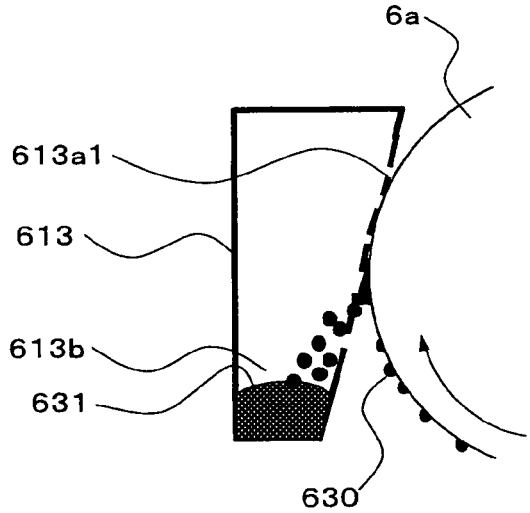
FIG. 7 is a schematic illustrative view showing a cleaning state when a mesh portion in a cleaning member of the present embodiment has a preferable mesh size.
Figure 8:
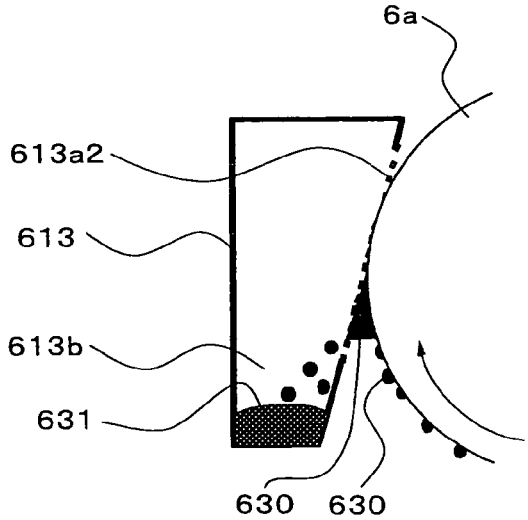
FIG. 8 is a schematic illustrative view showing a cleaning state when the mesh portion has a smaller mesh size.
Figure 9:
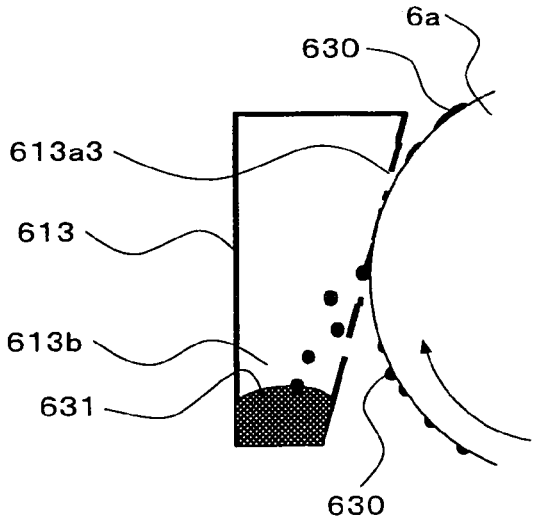
FIG. 9 is a schematic illustrative view showing a cleaning state when the mesh portion has a larger mesh size.

FIG. 7 is a schematic illustrative view showing the cleaning state when the mesh portion in the cleaning member of the present embodiment has a preferable mesh size; FIG. 8 is a schematic illustrative view showing the cleaning state when the mesh portion has a smaller mesh size; and FIG. 9 is a schematic illustrative view showing the cleaning state when the mesh portion has a larger mesh size.

Now, based on the configuration of cleaning element 613 of the present embodiment, verification result of the effect of cleaning the toner remaining on heat roller 6*a* depending on the mesh size of mesh portion 613*a* will be shown.

A reference numeral 613*a*1 in the drawing designates a mesh portion having a preferable mesh size, 613*a*2 designates a mesh portion having a small mesh size, and 613*a*3 designates a mesh having a large mesh portion, 630 designates paper dust/leftover toner, and 631 designates collected paper dust/leftover toner.

When the mesh portion 613*a*1 has a preferable mesh size, paper dust and leftover toner on heat roller 6*a* are collected into cleaning member 613 by mesh portion 613*a*1 and stored in toner collecting portion 613*b*, as shown in FIG. 7.

On the other hand, when mesh portion 613*a*2 has a small mesh size, paper dust stagnates on the outer side of mesh portion 613*a* as shown in FIG. 8, so that the paper dust and leftover toner mix up, stagnating between mesh portion 613*a*2 and heat roller 6*a*. If this state occurs, there is a fear that mesh portion 613*a*2 and/or heat roller 6*a* become damaged.

When mesh portion 613*a*3 has a large mesh size, paper dust and leftover toner pass through the mesh as shown in FIG. 9, and the ratio of collecting leftover toner lowers, causing cleaning deficiency of heat roller 6*a*.

As described heretofore, it is understood that the cleaning effect of cleaning member 613 becomes different depending on the mesh size of mesh portion 613*a*.

It is also known that the condition of the collected leftover toner differs depending on the amount of paper dust and generation of paper dust differs depending on the type (maker) of the paper.

To deal with this, in the present embodiment, a plurality kinds (makers) of paper (paper A, paper B, paper C and paper D) were used to verify the optimal mesh sizes of the mesh portion for various kinds of paper.

FIG. 10 is a paper comparison table showing data of paper types used in the present embodiment, and FIG. 11 is an evaluation table showing evaluation on cleaning when different kinds of paper are used with different mesh sizes of the mesh portion in the cleaning member according to the present embodiment.

In the present embodiment, as shown in FIG. 10, four kinds of paper, paper A, paper B, paper C and paper D, which are generally and widely used were used to evaluate the cleaning performance of heat roller 6*a*.

FIG. 11 shows the cleaning states depending on the mesh size G of the mesh portion using different kinds of paper. As shown in this, when mesh size G of mesh portion 613*a* was 1.2 mm, paper dust and toner clogged and the mesh portion was broken. With a mesh size G of 1.8 mm, no clogging of paper dust and toner was observed, but cleaning defect was observed.

In contrast, with a mesh size G of 1.4 mm, generally fair cleaning states were obtained through clogging of paper dust and toner was observed for some paper (paper B). With a mesh size G of 1.6 mm, fine cleaning states were obtained without any clogging in the mesh portion for all the four kinds of paper.

Accordingly, in the present embodiment, specifying the mesh size of mesh portion 613*a* to be greater than 1.4 mm and smaller than 1.8 mm based on the verified result, makes it possible to perform fair cleaning of paper dust and leftover toner on heat roller 6*a* without causing any clogging in the mesh portion. Thus, it is possible to make the life of cleaning member 613 longer with a reduced number of maintenance.

According to the embodiment having the configuration described heretofore, it is possible with cleaning member 613 having mesh portion 613*a* to efficiently collect the developers and paper dust (paper dust lumps made of paper dust and toner) remaining on the surface of heat roller 6*a*, hence it is possible to realize the long life configuration of cleaning member 613.

Further, according to the present embodiment, since mesh portion 613*a* and toner collecting portion 613*b* are integrally formed as a cleaning member 613 configuration, it is possible to hold a large amount of leftover toner (waste toner), hence it is possible to deal with high-speed operation even though the amount of cleaning increases as the image forming apparatus is enhanced in processing speed.

Though in the present embodiment, mesh portion 613*a* of cleaning member 613 is formed uniformly with a mesh of the same size, the mesh configuration of the mesh portion of the present invention should not be limited to this. For example, it is possible to provide a mesh configuration in which the mesh size on the downstream side of the rotation of heat roller 6*a*, i.e., the element to be cleaned, is smaller than that on the upstream side of the rotation thereof.

This configuration enables easy collection of leftover toner into the mesh portion in the area to be cleaned by the mesh portion on the upstream side of the rotation and makes it difficult for the collected toner to leak out in the area on the downstream side of the rotation. Accordingly, it is possible to efficiently collect leftover toner and paper dust from heat roller 6*a*.

In the present embodiment, cleaning member 613 is laid out along heat roller 6*a* so as to clean the heat roller 6*a*. The present invention, however, should not be limited to this. For example, the cleaning member may be arranged along pressing roller 6*b* so as to clean the pressing roller 6*b*.

In the case where the cleaning member of the present invention is provided for pressing roller 6*b*, it is preferred that the wire of the mesh portion for the cleaning member has a hardness higher than the surface hardness of pressing roller 6*b* when pressing roller 6*b* is formed of hard rubber (a material having resiliency).

Since, with this configuration, cleaning is performed by pressing the mesh portion of the cleaning member against heat roller 6*b* so that the wire of the mesh portion flexes and comes into area contact with the pressing roller 6*b* surface, it is possible to efficiently collect leftover toner and paper dust without damaging pressing roller 6*b*.

Next, another example of the present embodiment will be described.

The example as follows has almost the same configuration as that of the cleaning member for the image forming apparatus according to the above embodiment, so that the same components are allotted with the same reference numerals without description. That is, the main configuration of the apparatus should be referred to FIGS. 1 to 9.

In example 11, mesh portion 613*a* of cleaning member 613 of the embodiment shown in FIGS. 5, 6A and 6B is configured such that the mesh size becomes different depending on the position of the mesh abutting heat roller (fixing roller) 6*a*.

As shown in FIGS. 5, 6A and 6B, mesh portion 613*a* is formed of a plurality of heat-resistant wires crisscrossed with a predetermined mesh (grid mesh) G, and is arranged so that the plurality of wires oppose, and are put in contact with, peripheral surface 6*a*1 of heat roller 6*a*, running across the rotational direction of the heat roller 6*a*.

The mesh configuration of mesh portion 613*a* is formed lattice-like so that slanted lines L1 and L2 crisscrossed to each other and the mesh size in the downstream area of the rotation of the fixing roller is greater than that in the upstream area of the rotation of the fixing roller.

Here, in example 1, similarly to the aforementioned embodiment, the lower side of cleaning member 613 is the upstream side of rotation of heat roller 6*a* and the upper side is the downstream side of the rotation.

The mesh size in the area of mesh portion 613*a* on the upstream side of the rotation of heat roller 6*a* is configured to be greater than 1.2 mm and smaller than 1.5 mm while the mesh size in the area of mesh portion 613*a* on the downstream side of the rotation of heat roller 6*a* is configured to be greater than 1.4 mm and smaller than 1.8 mm. Specifically, mesh portion 613*a* is formed so that the mesh size in the area on the upstream side of the rotation of heat roller 6*a* is set at 1.4 mm and the mesh size in the area on the downstream side of the rotation of heat roller 6*a* is set at 1.6 mm.

With this configuration, according to example 1 it is possible to collect stuck substances different in size and adhering on the outer peripheral surface of heat roller 6*a*, e.g., leftover developers or toner, paper dust, mixture of paper dust and dirt contaminated in the leftover developers and the like, separately in conformity with the mesh size. Accordingly, it is possible to collect leftover developers, toner, paper dust etc., efficiently without causing any clogging in mesh portion 613*a* and cleaning defects.

More specifically, in accordance with example 1, small-sized leftover particles such as developers or toner can be collected by the area on the upstream side of the rotation of heat roller 6*a* where the mesh size is smaller while large-sized stuck substances such as large paper dust and dirt, which have not been collected by the area on the upstream side of the rotation of heat roller 6*a* can be collected by the area on the downstream side of the rotation of heat roller 6*a* where the mesh size is greater. Accordingly, it is possible to efficiently collect waste particles without causing any clogging in mesh portion 613*a*.

Example 2 is a variation of example 1, and mesh portion 613*a* of cleaning member 613 of the embodiment shown in FIGS. 5, 6A and 6B is configured such that the mesh size in the upstream area of the rotation of the fixing roller is greater than that in the downstream area of the rotation of the fixing roller.

The mesh size in the area of mesh portion 613*a* on the downstream side of the rotation of heat roller 6*a* is configured to be greater than 1.2 mm and smaller than 1.5 mm while the mesh size in the area of mesh portion 613*a* on the upstream side of the rotation of heat roller 6*a* is configured to be greater than 1.4 mm and smaller than 1.8 mm. Specifically, mesh portion 613*a* is formed so that the mesh size in the area on the downstream side of the rotation of heat roller 6*a* is specified at 1.4 mm and the mesh size in the area on the upstream side of the rotation of heat roller 6*a* is specified at 1.6 mm.

With this configuration, according to example 2 it is possible to collect stuck substances different in size and adhering on the outer peripheral surface of heat roller 6*a*, e.g., leftover developers or toner, paper dust, mixture of paper dust and dirt contaminated in the leftover developers and the like, separately in conformity with the mesh size. Accordingly, it is possible to collect leftover developers or toner, paper dust etc., efficiently without causing any clogging in mesh portion 613*a* and cleaning defects.

More specifically, in accordance with example 2, stuck substances of greater sizes than the developers or toner, such as large paper dust, dirt etc., together with the leftover developers or toner can be collected by the area on the upstream side of the rotation of heat roller 6*a* where the mesh size is greater while stuck substances of small sizes such as leftover developers or toner, dust and etc., which have leaked out through mesh portion 613*a* in the area located on the upstream of the rotation of heat roller 6*a* where the mesh size is greater, can be collected by the area on the downstream side of the rotation of heat roller 6*a* where the mesh size is smaller. Accordingly, it is possible to efficiently collect waste particles without causing any clogging in mesh portion 613*a*.

What is claimed is:

1. A cleaning member for cleaning a developer remaining on an outer peripheral surface of a fixing roller that fixes an unfixed developer image formed on a recording medium thereto by heating under pressure, comprising:

a mesh portion comprising a heat resistant wire, the mesh portion comprising a predetermined mesh in at least an area abutting the fixing roller of the cleaning member, wherein when the surface of the fixing roller is formed of a material having resiliency, the wire comprises a material having a higher hardness than a surface hardness of the fixing roller, wherein, when the surface of the fixing roller is formed of a material haying no resiliency, the wire comprises a material haying a lower hardness than a surface hardness of the fixing roller, wherein the mesh portion is arranged whereby a plurality of wires comprising the mesh portion come into contact with the fixing roller in a direction cutting across a rotational direction of the fixing roller, and wherein the mesh portion is constructed so that the mesh size of the area on a downstream side of a rotational direction of the fixing roller is different from the mesh size of the area on an upstream side of the rotational direction of the fixing roller.

2. The cleaning member according to claim 1, wherein a mesh size of the mesh portion is specified to be greater than 1.2 mm and smaller than 1.8 mm.

3. The cleaning member according to claim 1, wherein the wire comprises metal, hard resin fiber, or combination of these.

4. The cleaning member according to claim 1, wherein the wire is conductive and has a function of erasing electric potential charged on the fixing roller.

5. The cleaning member according to claim 1, wherein the mesh portion is constructed so that the mesh size of the area on a downstream side of a rotational direction of the fixing roller is greater than the mesh size of the area on an upstream side of the rotational direction of the fixing roller.

6. The cleaning member according to claim 5, wherein the mesh portion is constructed so that the mesh size of the area on the upstream side of the rotational direction of the fixing roller is specified to be greater than 1.2 mm and smaller than 1.5 mm, and the mesh size of the area on the downstream side of the rotational direction of the fixing roller is specified to be greater than 1.4 mm and smaller than 1.8 mm.

7. The cleaning member according to claim 1, wherein the mesh portion is constructed so that the mesh size of the area on an upstream side of a rotational direction of the fixing roller is greater than the mesh size of the area on a downstream side of the rotational direction of the fixing roller.

8. The cleaning member according to claim 7, wherein the mesh portion is constructed so that the mesh size of the area on the downstream side of the rotational direction of the fixing roller is specified to be greater than 1.2 mm and smaller than 1.5 mm, and the mesh size of the area on the upstream side of the rotational direction of the fixing roller is specified to be greater than 1.4 mm and smaller than 1.8 mm.

9. The cleaning member according to claim 1, wherein in the areas of the mesh portion different in mesh size, the mesh area of the mesh portion having a smaller mesh size collects at least a developer remaining on the outer peripheral surface of the fixing roller; and the mesh area of the mesh portion having a greater mesh size collects at least a stuck substance including paper dust, adhering on the outer peripheral surface of the fixing roller.

10. An image forming apparatus comprising:

an electrostatic latent image support configured to form a developer image with a developer;

a charger configured to charge a surface of the electrostatic latent image support;

a light exposure portion configured to form an electrostatic latent image on the surface of the electrostatic latent image support;

a developing portion configured to visualize the electrostatic latent image formed on the surface of electrostatic latent image support with the developer;

a transfer portion configured to transfer the developer image on the surface of the electrostatic latent image support to a recording medium;

a fixing portion configured to fix the developer image transferred on the recording medium to the recording medium by a fixing roller; and a cleaning member configured to clean a surface of the fixing roller, wherein the developer image electrophotographically formed on the surface of the electrostatic latent image support is transferred to the recording medium by a transfer electric field and then is fixed to the recording medium, the cleaning member comprising a mesh portion comprised of a heat resistant wire, the mesh portion having a predetermined mesh in at least an area abutting the fixing roller, wherein when the surface of the fixing roller is formed of a material having resiliency, the wire comprises a material having a higher hardness than a surface hardness of the fixing roller, wherein, when the surface of the fixing roller comprises a material haying no resiliency, the wire comprises a material haying a lower hardness than a surface hardness of the fixing roller, wherein the mesh portion is arranged whereby a plurality of wires comprising the mesh portion come into contact with the fixing roller in a direction cutting across a rotational direction of the fixing roller, and wherein the mesh portion is constructed so that the mesh size of the area on a downstream side of a rotational direction of the fixing roller is different from the mesh size of the area on an upstream side of the rotational direction of the fixing roller.

11. The image forming apparatus according to claim 10, wherein a mesh size of the mesh portion is specified to be greater than 1.2 mm and smaller than 1.8 mm.

12. The image forming apparatus according to claim 10, wherein the wire comprises metal, hard resin fiber, or combination of these.

13. The image forming apparatus according to claim 10, wherein the wire is conductive and has a function of erasing electric potential charged on the fixing roller.

14. The image forming apparatus according to claim 10, wherein the mesh portion is constructed so that the mesh size of the area on a downstream side of a rotational direction of the fixing roller is greater than the mesh size of the area on an upstream side of the rotational direction of the fixing roller.

15. The image forming apparatus according to claim 14, wherein the mesh portion is constructed so that the mesh size of the area on the upstream side of the rotational direction of the fixing roller is specified to be greater than 1.2 mm and smaller than 1.5 mm, and the mesh size of the area on the downstream side of the rotational direction of the fixing roller is specified to be greater than 1.4 mm and smaller than 1.8 mm.

16. The image forming apparatus according to claim 10, wherein the mesh portion is constructed so that the mesh size of the area on an upstream side of a rotational direction of the fixing roller is greater than the mesh size of the area on a downstream side of the rotational direction of the fixing roller.

17. The image forming apparatus according to claim 16, wherein the mesh portion is constructed so that the mesh size of the area on the downstream side of the rotational direction of the fixing roller is specified to be greater than 1.2 mm and smaller than 1.5 mm, and the mesh size of the area on the upstream side of the rotational direction of the fixing roller is specified to be greater than 1.4 mm and smaller than 1.8 mm.

18. The image forming apparatus according to claim 10, wherein in the areas of the mesh portion different in mesh size, the mesh area of the mesh portion having a smaller mesh size collects at least the developer remaining on the outer peripheral surface of the fixing roller; and the mesh area of the mesh portion having a greater mesh size collects at least a stuck substance including paper dust, adhering on the outer peripheral surface of the fixing roller.

* * * * *